US005109781A

United States Patent [19]

Sasamoto

[11] Patent Number: 5,109,781

[45] Date of Patent: May 5, 1992

[54] STACKING APPARATUS FOR SEWING MACHINE

[75] Inventor: Hideho Sasamoto, Chofu, Japan

[73] Assignee: Juki Corporation, Tokyo, Japan

[21] Appl. No.: 634,429

[22] Filed: Dec. 27, 1990

[30] Foreign Application Priority Data

Dec. 28, 1989 [JP] Japan ..... 1-150164[U]
May 17, 1990 [JP] Japan ..... 2-50762[U]

[51] Int. Cl.[5] ..... D05B 33/00
[52] U.S. Cl. ..... 112/121.29; 271/175
[58] Field of Search ..... 112/121.29; 271/175

[56] References Cited

U.S. PATENT DOCUMENTS 3,704,884 12/1972 Nicolay et al. ..... 112/121.29 X
3,788,248 1/1974 Marforio ..... 112/121.29
4,067,272 1/1978 Maifario ..... 112/121.29
4,768,773 9/1988 Mall et al. ..... 112/121.29 X
4,787,325 11/1988 Black et al. ..... 112/121.29
4,790,523 12/1988 Tomer ..... 112/121.29 X

FOREIGN PATENT DOCUMENTS 2037713 7/1980 United Kingdom ..... 112/121.29

*Primary Examiner*—Werner H. Schroeder
*Assistant Examiner*—Paul C. Lewis
*Attorney, Agent, or Firm*—Morgan & Finnegan

[57] ABSTRACT

A stacking apparatus for a sewn workpiece, adapted for clamping, draping such workpiece as is one-sidely thicker which is buttoned or buttonholed by a button sewing machine or buttonholing machine. The apparatus is capable of stacking the workpiece in parallel with the horizontal, thus ensuring stability of the workpiece as stacked even if a multiple of the one sidedly thicker workpieces are stacked.

7 Claims, 3 Drawing Sheets (PRIOR ART)

STACKING APPARATUS FOR SEWING MACHINE

BACKGROUND OF THE INVENTION

This invention relates to a stacking apparatus for a sewing machine, and more particularly to a stacking apparatus which is adapted to stack workpieces which are, for example, one-sidedly thicker as a result of sewing buttons to the workpiece on one side thereof or buttonhole stitching the same.

As is well known to those skilled in the art, there has in the past been proposed a workpiece stacker of the type shown in FIG. 4, which is arranged to dispose a workpiece carrier b under a work-table a of a sewing machine. The workpiece carrier b is swingably rotated about a pivot b1 provided at the lower end thereof. An arm g is so mounted as to be swung about the pivot b1 to move a horizontal member b2 and horizontally supports at its forward end a workpiece draper e in parallel with a horizontal member b2. Reference characters c, d designate two cylinders for pivoting the workpiece carrier b and the arm g, respectively. Reference characters f, h, and i denote a workpiece feeding conveyor, a button and a sewn workpiece, respectively.

An arrangement of this type makes the workpiece carrier b swingable about the pivot b1 in the direction of an arrow A to allow the horizontal member b2 of the workpiece carrier b to press the neighborhood of the lower end of the sewn workpiece suspended from the work-table a of the sewing machine against the one side of the workpiece draper e. The workpiece carrier b and workpiece draper e hold the lower end of the workpiece therebetween and are pivoted about he pivot b1, thus moving the workpiece carrier b in the direction of the work-table (an arrow B) upon passing through a position where the workpiece is suspended. The workpiece i is further fed by the conveyor f and stacked on the draper e. Thereafter, the carrier b and draper e are returned to a position shown by a solid line to be ready for the next stacking of the workpiece.

When used in a button sewing machine, the conventional workpiece stacker is likely to tend to render thicker the side of the workpieces to which buttons are applied than the other side edge thereof to which no button is applied, thereby failing to keep the workpieces in a stack. This will require additional labor since the workpieces should be re-stacked when conveyed to the next process step. Another disadvantage derived from the workpiece stacker is that the number of the workpieces to be stacked is limited due to the thickness of the button sewed or buttonhole stitched workpieces.

As shown in FIG. 5, the stack of the workpieces takes a shape of a truncated pyramid as the workpieces are successively stacked to provide a trapezoid, at the top of the stack, whose base side length D is greater than the side C opposite thereto and which is placed at an angle with the horizontal. This will prevent the carrier from performing its function and narrow the space between the work-table a and the carrier so that the volume of the stack may be limited.

SUMMARY OF THE INVENTION

It is an object of the invention to provide a stacker for one sidedly thicker workpiece, which overcomes the defects inherent to the prior art and is capable of stacking a great number of the workpieces without getting out of the shape of stack even if each of the workpieces have one edge to which buttons are applied.

The aforementioned and other objects of the invention are accomplished by providing a stacker for one sidedly thicker workpieces (such as where one side of the workpiece is buttoned or buttonhole stitched by a button sewing machine or a buttonholing machine) including a workpiece carrier adapted to hold between the carrier and one side of the workpiece stacker a sewn workpiece hung from the work-table to throw over the center of the workpiece then turning over the workpiece on the carrier by means of a throw-over member for stacking the workpieces. A means is also provided for tilting the draper according to the number of workpieces to be stacked, that is, an amount or a volume of the stack.

According to the workpiece stacker of the present invention, a tilt of the draper is varied according to the volume of the stack, namely, the number of the workpieces to be stacked to render the top of the workpieces horizontal at all times, and the side of the workpiece carrier is adapted to hold its side in parallel to the draper.

A functional advantage of the invention is that the buttoned or buttonholed side of each of the workpieces in a stack is prevented from being bulged according to the increase in the number of the workpieces. At the same time, the surface of the uppermost workpiece is held in parallel with the workpiece carrier at all times so that the number of the workpieces to be stacked may be increased.

BRIEF DESCRIPTION OF THE DRAWINGS

The invention will not be described further, by way of example only, with reference to the accompanying drawings illustrating embodiments thereof and in which.

DETAILED DESCRIPTION OF THE DRAWINGS

Figure 1:
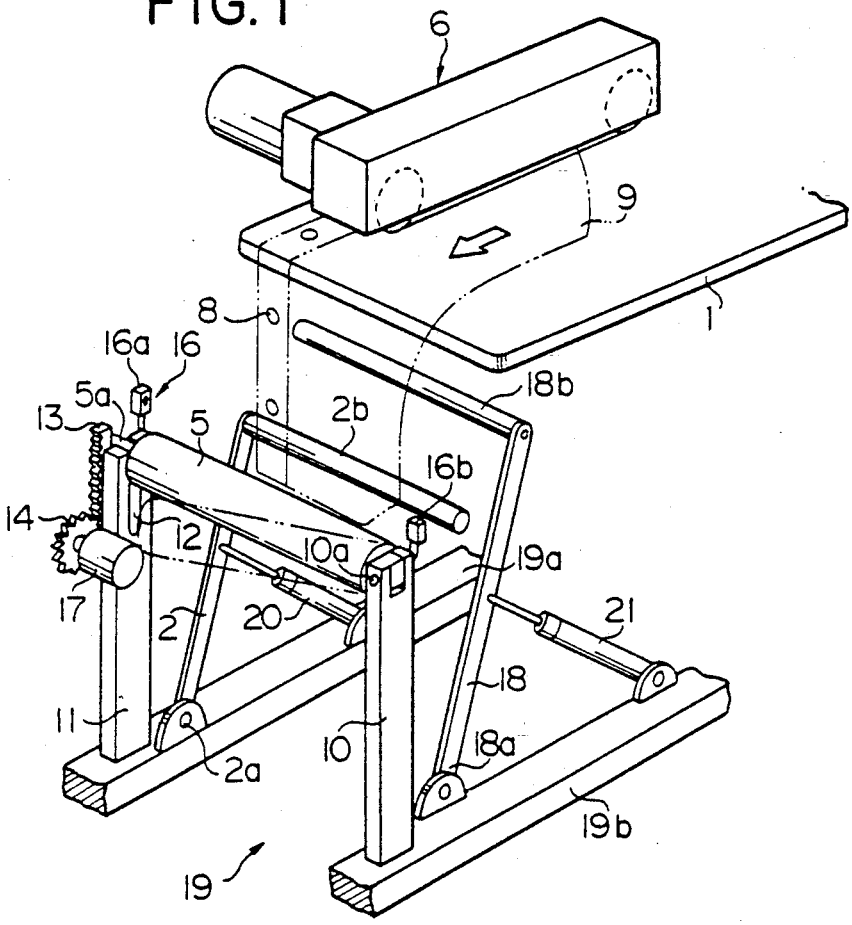
FIG. 1 is an explanatory perspective representation showing a workpiece stacker according to the invention.
Figure 2:
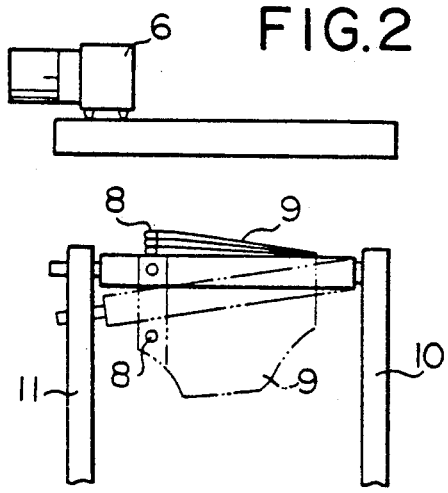
FIG. 2 is an explanatory representation of the relationship between a workpiece stacker and workpieces.

As shown in FIG. 1, a workpiece stacker 19 is arranged under a work-table 1 of a sewing machine. The stacker is provided in its frame with a leg 19*a* on which a lower end of a workpiece carrier 2 is rotatably supported. The carrier 2 includes a horizontal member 2*b* positioned closer to the part of the table 1 but ahead of a workpiece 9 hung from the table. The workpiece carrier 2 is moved by an air cylinder 20 supported on a leg 19*a* to swing in such a manner that its horizontal member 2*b* intersects the passage of suspended sewn workpiece to engage the workpiece draper.

A workpiece throw-over member 18 is adapted to pivotally mount its lower end 18*a* on the other leg 19*b* so as to rotate about the same axis of rotation of the workpiece carrier. The throw-over member also includes a horizontal member 18*b* similar to the horizontal member 2*b* of the workpiece carrier 2, which is positioned closer to the part of the table 1 but ahead of the workpiece 9.

The throw-over member 18 is caused to intersect the passage of the suspended sewn workpiece by another air cylinder 21 supported on the leg 19*b* to swingably move upwardly of the passage of movement of the horizontal member 2*b*. The workpiece draper 5 includes not only one end with which the buttonless edge of the workpiece is in registry when the latter is draped over and which is rotatably supported by a pin 10*a* on the upper end of a support 10 but also the other end from which a flat finger 5*a* extends to fit in a vertical groove 12. The flat finger is provided at its free end with a rack 13 fixed thereto, with which a pinion 14 rotatably supported on the support 11 meshes.

Rotation of the pinion 14 is controlled by a stepping motor 17 mounted on the support 11. A transmissive sensor 16 is disposed upwardly of the supports 10, 11 to sense the level of the top of the workpiece 9 laid on the workpiece draper 5 and consists of a light emitter 16*a* and a light receiver 16*b*. The transmissive sensor 16 is caused to drive the stepping motor 17 when the workpieces are draped to a predetermined level so that the pinion 14 is rotated to allow the rack 13 to lower the lower end of the carrier unit 5 relative to the other support.

The workpieces 9 are successively fed on the worktable 1 by a workpiece feed conveyor 6 arranged thereon until the leading end of the workpiece 9 passes through the horizontal member 2*b* of the workpiece carrier 2 to have the horizontal member 2*b* extended therefrom t a certain extent. Such feed rate of the workpiece carried by the conveyor is detected in a conventional manner. At this moment, the air cylinder 20 is actuated to rotate the workpiece carrier 2 so that the horizontal member 2*b* is in contact with the stacker unit with the lower portion of the workpiece clamped between the carrier and the horizontal member 2*b*.

When the workpiece feed conveyor has finished a workpiece feed to remove the trailing end of the workpiece from the conveyor 6, the throw-over member 18 is rotated under action of the air cylinder 21 to have the horizontal member 18*b* of the throw-over member 18 intersected and thrown over the workpiece, thereby stacking the workpiece on the draper 5.

The workpieces when successively stacked on the draper to a great height to position the button sewed side of the workpiece above a certain level of the top thereof is subjected to detection of the sensor 16 to actuate the stepping motor 17 for rotation of the pinion 14, thereby lowering the rack 13. As the rack is lowered, the other end of the draper is lowered relative to the other support 11 to render the top of the workpiece 9 as stacked horizontal.

In this connection, it is noted that the drive mechanism may be composed of the rack 13, the pinion 14, and the motor 17.

Although the invention is designed so that a difference in thickness between the opposite sides of the workpieces as stacked to a certain extent is premeasured to allow a sensor to sense the height of the stacked sewn workpieces, the number of the sewn workpieces in a stack may be counted to control the stepping motor, thus varying an angle of inclination of the workpiece stacking member. In this connection, it is noted that the transmissive sensor 16 for detecting the level of the top of the uppermost workpiece 9 also serves as means for determining the volume of the workpieces.

A ratchet, an air cylinder, and a solenoid or the like may be substituted for the stepping motor 17 so that a means for controlling the pinion 14 may be taken advantage of.

Figure 3:
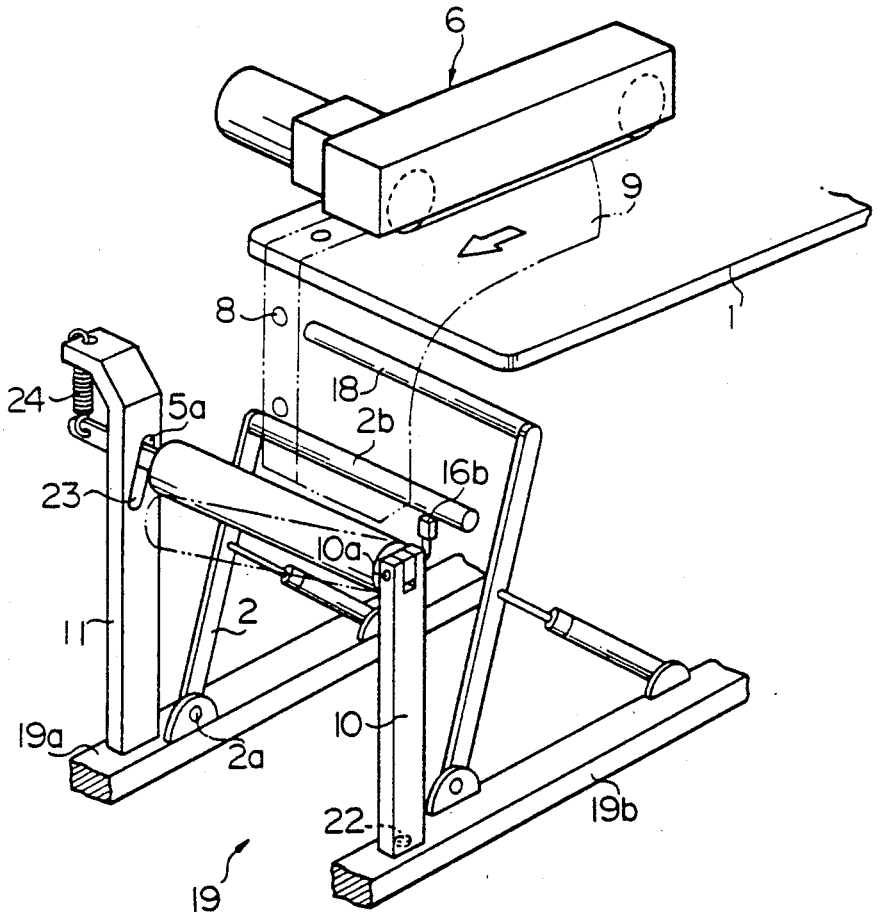
FIG. 3 is a perspective view of another embodiment of the invention.
Figure 4:
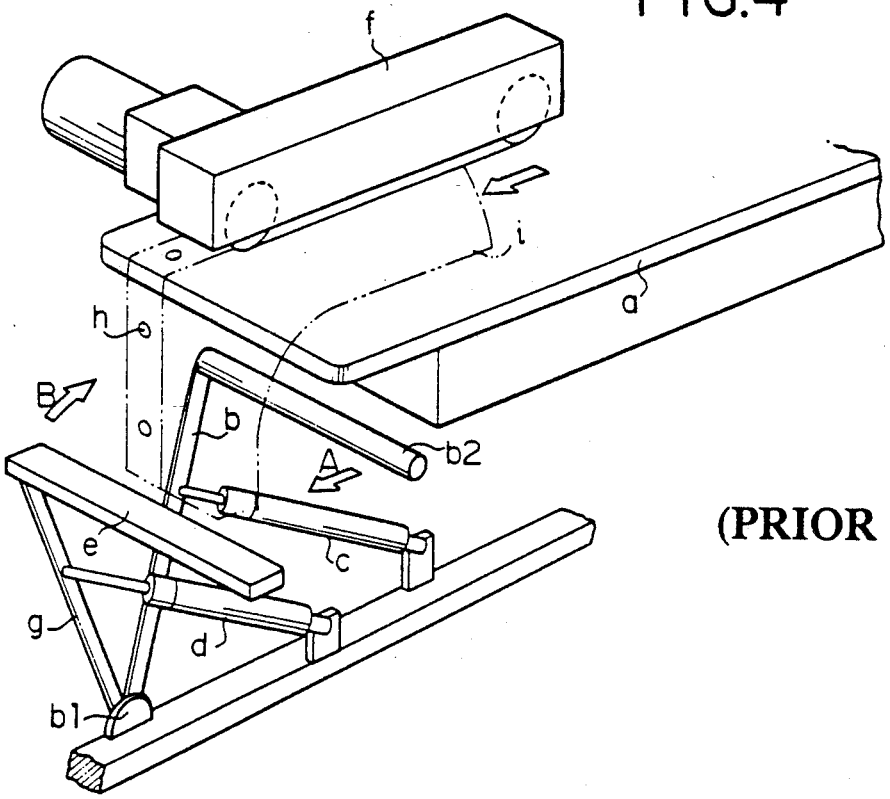
FIGS. 4 and 5 are representations explanatory of a convention workpiece stacker.
Figure 5:
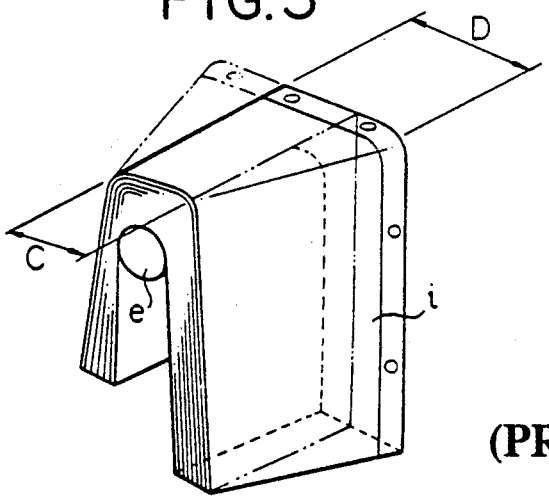
(PRIOR ART) FIG.5

According to another embodiment of the invention in FIG. 3, one support 10 in the first embodiment shown in FIG. 1 is adapted to support its lower end by a vertical pivot pin 22 on the frame 19 to swing the support 10 about the pin 22. The other support 11 is provided at its upper portion with a slot 23 diagonally formed to have the lower end thereof become farther apart from the plane of the work table 1 to so slidably pass the flat finger 5*a* through the slot. The flat finger 5*a* of the draper 5 is hung by a spring 24 from the top of the support 11. With this arrangement, the workpiece draper 5 is gradually lowered against the bias of the spring 24 according to the weight of the workpieces when stacked thereon by sliding the flat finger 5*a* down along the slot 23.

In this embodiment of the invention, a slide of the flat finger 5*a* along the slot 23 allows one end of the draper with the flat finger to attain the lower level of the support 11. As a result, the draper 5 is tilted to be in a position shown by a dot and dash line to keep the unit away from the workpiece carrier. This will render the uppermost workpiece horizontal to hold the workpiece carrier in parallel with the horizontal member 2*b*.

In a further embodiment, in substitution for the pivot pin 22 which is used in the aforementioned embodiment to make one support 10 rotatable as in the second embodiment, the support may be provided at its upper end with a means for adapting the pin 10*a* for a vertical and rotatable movement.

We claim:

1. A stacking apparatus for stacking a sewn workpiece, comprising:

a workpiece draper;

a workpiece carrier for holding the sewn workpiece against said workpiece draper;

a throw-over member for folding the sewn workpiece to stack the workpiece on said workpiece draper; and means for inclining said workpiece draper according to the amount of workpieces stacked on said workpiece draper, wherein said inclining means comprises:

means for rotatably supporting one end of said workpiece draper so that said workpiece draper can rotate in vertical and horizontal directions;

means for suspending a second end of said workpiece draper via a spring; and means for guiding said second end of said workpiece draper so that said second end of said workpiece draper can obliquely move downward.

2. A stacking apparatus as recited in claim 1 wherein said inclining means further comprises means for moving said second end of said workpiece draper away from said workpiece carrier as said second end of said workpiece draper is being guided downwardly.

3. In a sewing machine, a stacking apparatus for stacking a sewn workpiece as recited in claim 2 wherein said sewing machine further includes means for attaching a button to said workpiece.

4. In a sewing machine, a stacking apparatus for stacking a sewn workpiece as recited in claim 1 wherein said sewing machine further includes means for opening a buttonhole in said workpiece.

5. A stacking apparatus for stacking sewn workpieces, comprising:

a workpiece draper;

a workpiece carrier for holding the sewn workpiece against said workpiece draper;

a throw-over member for folding the sewn workpiece to stack the workpiece on said workpiece draper;

means for sensing an amount of workpieces on said workpiece draper; and inclining means controlled by said sensing means for inclining said workpiece draper, wherein said inclining means comprises:

a pair of supports including a first support and a second support, said first support rotatably supporting one end of said workpiece draper so that said workpiece draper can be inclined, said second support supporting a second end of said workpiece draper so that said second end of said workpiece draper can move vertically; and means for driving said second end of said workpiece draper in response to said inclining means.

6. A stacking apparatus as recited in claim 5, wherein said inclining means comprises means for moving said second end of said workpiece draper away from said workpiece carrier as said other end of said workpiece is draper being guided downwardly.

7. In a sewing machine, a stacking apparatus for stacking a sewn workpiece, comprising:

a workpiece draper having a rack at a first end thereof;

a workpiece carrier for holding the sewn workpiece against said workpiece draper;

a throw-over member for folding the sewn workpiece to stack the workpiece on said workpiece draper;

means for sensing an amount of workpieces on said workpiece draper;

a first support for rotatably supporting a second end of said workpiece draper so that said workpiece draper can rotate in a vertical direction;

a second support for supporting said first end of said workpiece draper;

a pinion rotatably supported on said second support for engaging with said rack of said workpiece draper and inclining said workpiece draper; and means responsive to said sensing means to drive said pinion.

* * * * *